United States Patent [19]

Sayles

[11] Patent Number: 4,812,179

[45] Date of Patent: Mar. 14, 1989

[54] METHOD OF INCREASING THE BURNING RATE ENHANCEMENT BY MECHANICAL ACCELERATORS

[75] Inventor: David C. Sayles, Huntsville, Ala.

[73] Assignee: The United States of America as represented by the Secretary of the Army, Washington, D.C.

[21] Appl. No.: 654,078

[22] Filed: Sep. 10, 1984

[51] Int. Cl.[4] ..... C06B 45/10

[52] U.S. Cl. ..... 149/19.2; 149/2; 149/19.8; 149/20; 427/217

[58] Field of Search ..... 149/19.2, 19.8, 20, 149/2; 427/217

[56] References Cited

U.S. PATENT DOCUMENTS

| | | | |
|---|---|---|---|
| 3,389,025 | 6/1968 | Nix et al. | 149/2 |
| 3,508,494 | 4/1970 | Caveny | 102/102 |
| 3,764,420 | 10/1973 | Sayles | 149/19.8 |
| 3,784,419 | 1/1974 | Baumann et al. | 149/2 |
| 3,954,527 | 5/1976 | Sayles | 149/19.2 |
| 4,072,546 | 2/1978 | Winer | 149/19.8 |
| 4,140,561 | 2/1979 | Keith et al. | 149/2 |
| 4,410,470 | 10/1983 | Sayles | 149/19.2 |
| 4,441,942 | 4/1984 | Sayles | 149/19.8 |
| 4,655,859 | 4/1987 | Sayles | 149/19.2 |

*Primary Examiner*—Edward A. Miller

[57] ABSTRACT

The mechanical burning rate accelerators, e.g., graphite linters or aluminum whiskers, which are employed to enhance the burning rate of solid propellants are modified by depositing specks of metal selected from the group of metals consisting of iron, vanadium, or palladium on the graphite linters or aluminum whiskers. An increase in burning rate of the propellant composition is achieved when the modified mechanical burning rate accelerators in an approximately equal percentage by weight is substituted for the unmodified graphite linters or aluminum whiskers in the propellant composition. During the propellant burning the specks of metal generate localized hot spots of heat which is graphite linters or aluminum whiskers conduct into the propellant and thereby produces the increase in burning rate. The propellant with which the modified mechanical burning rate accelerators is evaluated comprised nitrocellulose, nitroglycerine, carboranylmethyl propionate, stabilizers, ammonium perchlorate, aluminum casting powder portion, and the modified mechanical burning rate accelerators in a major portion of nitroglycerine, a minor portion of a stabilizer, and a minor portion of a plasticizer in a casting solvent portion.

3 Claims, 1 Drawing Sheet

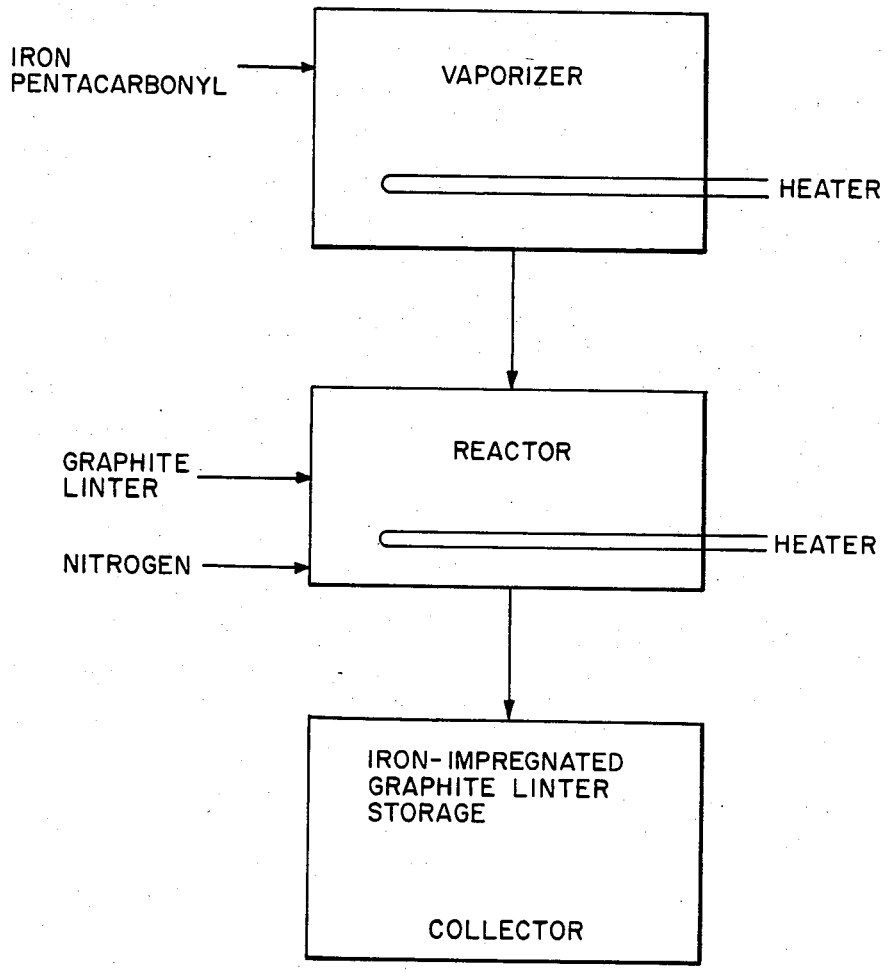
IRON
PENTACARBONYL
VAPORIZER
HEATER
GRAPHITE
LINTER
NITROGEN
REACTOR
HEATER
IRON-IMPREGNATED
GRAPHITE LINTER
STORAGE
COLLECTOR

METHOD OF INCREASING THE BURNING RATE ENHANCEMENT BY MECHANICAL ACCELERATORS

DEDICATORY CLAUSE

The invention described herein may be manufactured, used, and licensed by or for the Government for governmental purposes without the payment to me of any royalties thereon.

BACKGROUND OF THE INVENTION

The burning rates of solid propellant compositions have been increased by various innovations which have included metal oxides, metal staples, and organometallic compounds including carborane and ferrocene compounds. One of the most widely used materials for improving burning rates has been metal staples. Metal staples in the form of multidimensional crosses have been used. The staples have been of various cross sectional shapes including rectangular, square, or circular. Aluminum metal has been one of the most widely used metal since it has been readily available at an economical price. Aluminum and other metals have been introduced as particles in the form of continuous wires or ribbons, short wires or ribbons, chopped foil, platelets, flake, and the like.

The prior art has performed experimentation with composite staples consisting of layers of a propellant fuel metal (e.g., aluminum and a ferromagnetic metal, e.g., nickel). The prior art has taught that ferromagnetic metal detracts from propellant performance, but the detrimental effects are minimized when a minimum effective amount is employed in order to control staple orientation using an applied magnetic field. The detraction of the ferromagnetic metal from propellant performance is offset by a gain due to staple orientation which is most effective when the staple is oriented perpendicular to burning surface. The prior art metal composite for the described use employed epoxy resin or coating, one on the other, to bond the two metals together.

More recently graphite linters and aluminum whiskers have been employed in solid propellant compositions as mechanical burning rate accelerators. The function of the graphite linters and aluminum whiskers take place at the combustion site whereby heat generated at the combustion site is conducted into the propellant grain to further promote the propagation of the flame front and thereby accelerate the burning rate.

A modification in the structure of the graphite linters and aluminum whiskers which results in an increase of their function would be an advantage since a higher acceleration rate to the burning rate could be achieved with the same weight percentage employed. A further advantage is recognized in that graphite linters and aluminum whiskers having a higher efficiency would enable the same burning rate to be retained while employing a lesser weight percentage in the propellant composition.

SUMMARY OF THE INVENTION

The mechanical burning rate accelerators, e.g., employed to enhance the burning rate of solid propellants are modified by depositing specks of metal selected from the group of metals consisting of iron, vanadium, or palladium on the graphite linters or aluminum whiskers.

During the burning of a propellant composition containing the modified linters or aluminum whiskers, the specks of metal generate localized hot spots of heat which the aluminum whiskers or graphite linters conduct into the propellant, and thereby produces the increase in burning rate. The modified mechanical burning rate accelerators when used in the same weight percentage because of their higher efficiency achieve a higher burning rate for the propellant composition. Also, if the same burning rate is desired a lesser weight percentage of the modified mechanical burning rate accelerators is employed.

The propellant, in which the modified mechanical burning rate accelerators is evaluated comprises in weight percentages, of the following: a casting powder portion consisting of: nitrocellulose 23.0, nitroglycerine 8.5, carboranylmethyl propionate 6.5, stabilizers 2.5, ammonium perchlorate 45.5 of about 2.0 μm particle size, aluminum 11.0 of about 20 μm particle size, and the added modified mechanical burning rate accelerators, e.g., iron-impregnated graphite linters 3.0; and a casting solvent portion, in weight percentage, comprised of: nitroglycerine 90, 2-nitrodiphenylamine 1.0, and triacetin 9.0. The control propellant comprised a like formulation except the graphite linters were not modified.

BRIEF DESCRIPTION OF THE DRAWING

The single FIGURE of the drawing depicts a flow chart for the preparation of iron-impregnated graphite linters.

DESCRIPTION OF THE PREFERRED EMBODIMENT

Mechanical burning rate accelerators selected from graphite linters and aluminum whiskers are modified by the deposition of specks of metal selected from the group of metals consisting of iron, vanadium, and palladium. The modified burning rate accelerators generate localized hot spots at the site of the metal specks from which the heat is conducted into the propellant, and produce the increase in burning rate.

A comparison of the effectiveness of the mechanical burning rate accelerator, iron-impregnated graphite linters, as compared with the graphite linters employed in a double-base castable propellant composition is shown in Table I below.

TABLE I

COMPARISON OF PROPELLANTS WITHOUT AND WITH IMPREGNATED MECHANICAL BURNING RATE ACCELERATORS

| INGREDIENT | PROPELLANT A | PROPELLANT B |
|---|---|---|
| Casting Powder | | |
| Nitrocellulose | 23.0 | 23.0 |
| Nitroglycerine | 8.5 | 8.5 |
| Carboranylmethyl Propionate | 6.5 | 6.5 |
| Stabilizers | 2.5 | 2.5 |
| Ammonium Perchlorate (2.0 μm) | 45.5 | 45.5 |
| Aluminum (20 μm) | 11.0 | 11.0 |
| Graphite Linters | 3.0 | 0 |
| Iron-Impregnated Graphite Linters | 0 | 3.0 |
| Casting Solvent | | |
| Nitroglycerine | 90 | 90 |
| 2-Nitrodiphenylamine | 1 | 1 |
| Triacetin | 9 | 9 |
| Properties | | |
| Burning rate (ips @ 2000 psi) (Strands) | 9.2–10.1 | 12.1–12.7 |

TABLE I-continued

COMPARISON OF PROPELLANTS WITHOUT AND WITH IMPREGNATED MECHANICAL BURNING RATE ACCELERATORS

| INGREDIENT | PROPELLANT A | PROPELLANT B |
|---|---|---|
| (CM/S @ 14 MPa) | 23.4–25.7 | |
| Pressure Exponent | 0.65–0.72 | 0.57–0.59 |
| Tensile Strength (MPa) (psi) | 2.28/325–2.95/416 | 2.39/340 |
| Strain strength (MPa) (psi) | 2.28/325–2.95/416 | 2.39/340 |
| Strain @ Max Stress | 35–54 | 40–55 |
| Modulus (MPa)/psi) | 6.3/900–7.1/1016 | 6.3/900 |

The technique for impregnation of the graphite linters or aluminum whiskers with the specified metallic materials can be accomplished durhg their manufacture using available technology. The background and specific knowledge of how metal carbonyls are employed to render high purity metals for impregnating the grahpite linters or aluminum whiskers are set forth hereinbelow.

As a transition metal, iron combines with carbon monoxide to form a group of compounds which have the general formula of $M_x(CO)_y$ where M is a metal in the zero oxidation state, and where x and y are integers. The metal carbonyls have been useful in the preparation of high purity metals.

The Sidgwick concept of "effective atomic number" (EAN) (sometimes referred to as the "inert gas rule") requires that the metal react with sufficient number of carbon monoxide molecles (in which each carbon supplies a lone pair of electrons) to allow the metal to achieve the electron structure of the subsequent inert gas in the periodic table. Because transition metals are involved in carbonyl formation, it is sometimes necessary for the CO molecules to fill the d orbitals of each metal, in addition to the s and p orbitals that make up the outer shell of the inert gas. For example, iron metal, atomic number 20, reacts with five CO molecules to fill the four 3d and six 4p orbitals; and, thus, is converted into a compound which has an extranuclear electron cnfiguration identical with that of the following inert gas, krypton, with an atomic number of 36.

The structure of the mononuclear carbonyl of iron displays the unusual coordination number of 5. The presence of a small dipole moment has led to several attempts to postulate a structure in which the iron-carbon bonds were non-equivalent, but polarization effects may be the true explanation for the dipole moment. The lone pair of electrons of the iron must form pi bonds, and, therefore, is not stereochemically effective; otherwise, a square-pyramidal such a tetragonal pyramid on the basis of infrared data (structure 1), but most evidence favors the trigonal bipyramid ($dsp^3$) arrangement (structure 2). The zero-valent iron has, thus, assumed an electronic configuration which permits the $3d_{z^2}$ orbital to participate in $dsp^3$ hybrid orbitals accommodating the five CO electron pairs.

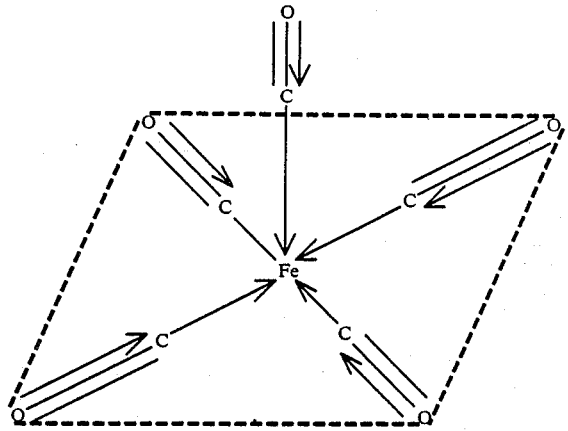

Structure 1

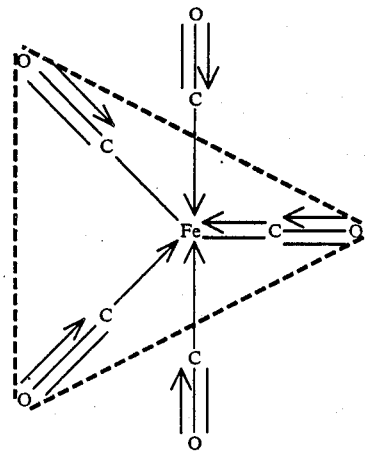

Structure 2

-continued

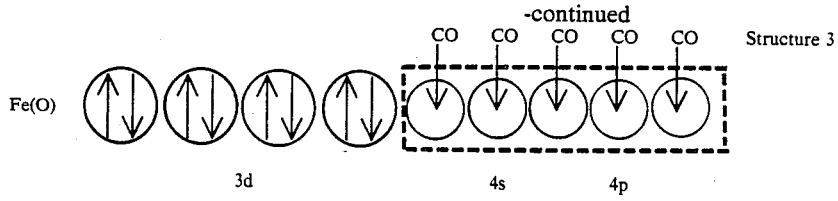

Iron pentacarbonyl is prepared commercially by direct carbonylation of iron under pressure to form the liquid compound, using sulfur as a promotor for the reaction.

Physical properties of the $Fe(CO)_5$ are as follows:

| | |
|---|---|
| Color | Yellow to red Viscous Liquid |
| Melting Point (°C./°F.) | −20/−4 |
| Boiling Point (760 mm) | (°C./°F.)103/217 |
| Density (g/ml) (25°/4°) | 1.453 |
| Flash Point (°C.) | 35 |
| Vapor Pressure (mm @ 30° C.) | 40 |
| Molecular weight | 195.9 |

The iron powder which is produced by the decomposition of iron pentacarbonyl is a highly pure form of iron, and is free of other metals. It is produced in the form of almost perfect spheres ranging in diameter from 1–15 microns, the average being 8 microns (0.00032 inches).

The only contaminants which were found to be present in these types of iron particles are nonmetals, such as, carbon, oxygen, and nitrogen. These were present of the order of less than 0.8%, 0.9% and 0.07% respectively. These, by their very nature have little observable effect when the iron was deposited on the linters.

To effect the deposition of the iron onto the graphite linters the iron pentacarbonyl is vaporized, and the vapor heated above 200° C., at which temperature it decomposes into its constituents. The carbon monoxide which is produced is driven off, and the iron separates from the vapor phase, first in the form of free atoms, then as ultramicroscopic crystals, and, finally, as microscopic, almost perfect, spheres. The particle size distribution can be controlled by varying the temperature, pressure, and other operating conditions. Deposition of the microscopic iron onto graphite linters, or other substrates, is accomplished by introducing the graphite linters into the reaction chamber through an orifice using nitrogen as the conveyer gas. A flowsheet from the preparation of iron-impregnated chopped graphite linters is presented in the single figure of the drawing. When these microscopic iron spheres are deposited on the graphite linters they can, then, function as focii for the combustion process.

In this investigation, the ratio of iron deposited on graphite linters was 1 g per 1000 g.

Similarly, other metal carbonyls can be employed to effect deposition of other high purity metals on graphite linters, or other substrates, as described for the iron carbonyl which is illustrative of the impregnated mechanical burning rate accelerators of this invention.

I claim:

1. In a propellant composition comprising nitrocellulose, nitroglycerine, carboranylmethyl propionate, stabilizers, ammonium perchlorate, aluminum, and a mechanical burning rate accelerator selected from the group consisting of graphite linters and aluminum whiskers, the improvement in burning rate comprising substituting a substantially equal amount by weight of an impregnated mechanical burning rate accelerator for said mechanical burning rate accelerator, said impregnated mechanical burning rate accelerator being graphite linters or aluminum whiskers that have been modified to include a deposition on said graphite linters or said aluminum whiskers specks of metal selected from the group consisting of iron, vanadium, and palladium.

2. In a propellant composition as set forth in claim 1, wherein the propellant composition constitutes a casting powder formulation and said casting powder formulation is incorporated with a casting solvent comprising a major portion of nitroglycerine, a minor portion of stabilizer, and a minor portion of a plasticizer.

3. In a propellant composition, as set forth in claim 2, wherein said casting powder includes in weight percentages said nitrocellulose in an amount of about 23, said nitroglycerine in an amount of about 8.5, said carboranylmethyl propionate in an amount of about 6.5, said stabilizers in an amount of about 2.5, said ammonium perchlorate of about 2.0 m particle size in an amount of about 45.5, said aluminum is of about 20 μm particle size in an amount of about 11.0, said impregnated mechanical burning rate accelerator is iron-impregnated graphite linters in an amount of 3.0, and wherein said casting solvent comprises said nitrocellulose in amount of about 90, said stabilizer is 2-nitrodiphenylamine in an amount of about 1.0, and said plasticizer is triacetin in an amount of about 9.0.

* * * * *